US006231694B1

(12) United States Patent
Yuki et al.

(10) Patent No.: US 6,231,694 B1
(45) Date of Patent: May 15, 2001

(54) PROCESS FOR PRODUCING FE-NI ALLOYS USED FOR ELECTRON GUN PARTS

(75) Inventors: Norio Yuki; Yoshihisa Kita, both of Kanagawa-ken (JP)

(73) Assignee: Nippon Mining & Metals Co., LTD, Tokyo (JP)

( * ) Notice: Subject to any disclaimer, the term of this patent is extended or adjusted under 35 U.S.C. 154(b) by 0 days.

(21) Appl. No.: 09/239,049

(22) Filed: Jan. 27, 1999

(30) Foreign Application Priority Data

Mar. 16, 1998 (JP) ..... 10-084924

(51) Int. Cl.[7] ..... C21D 8/00; C22F 1/10
(52) U.S. Cl. ..... 148/505; 148/547; 148/677
(58) Field of Search ..... 420/94; 148/547, 148/621, 651, 336, 676, 677, 503, 504, 505, 501

(56) References Cited

U.S. PATENT DOCUMENTS 5,891,271 * 4/1999 Yuki et al. ..... 148/331
5,962,965 * 10/1999 Yuki et al. ..... 313/441

OTHER PUBLICATIONS

English language abstract of Japanese Patent Publication No. 06122945 A dated May 6, 1994.
English language abstract of Japanese Patent Publication No. 06184703 A dated Jul. 5, 1994.
English language abstract of Japanese Patent Publication No. 07003400 A dated Jan. 6, 1995.
English language abstract of Japanese Patent Publication No. 07034199 A dated Feb. 3, 1995.
English language abstract of Japanese Patent Publication No. 10265911 A dated Oct. 3, 1998.

* cited by examiner

*Primary Examiner*—Deborah Yee
(74) *Attorney, Agent, or Firm*—Scully, Scott, Murphy & Presser

(57) ABSTRACT

Disclosed is a process for producing Fe—Ni alloys used for electron gun parts. The alloy consists of: all by weight, 30 to 55% of Ni; 0.05 to 2.00% of Mn; 0.001% to 0.050 of S; and the balance of Fe and inevitable impurities. The process substantially consists of melting, casting, hot working, cold rolling and annealing. The Fe—Ni alloy satisfies $0.0005 \leqq ((\%Mn)*(\%S)) \leqq 0.0100$. The hot working is carried out at a temperature T defined by the following equation.

$$1050 \leqq T^{\circ}\,C. \leqq \frac{9500}{3.1 - \log((\%\,Mn)*(\%\,S))} - 350.$$

3 Claims, 3 Drawing Sheets

(a)

(b)

PROCESS FOR PRODUCING FE-NI ALLOYS USED FOR ELECTRON GUN PARTS

BACKGROUND OF THE INVENTION

This invention relates to a process for producing Fe—Ni alloys with improved punching properties suitable as materials for electron gun parts, such as electrodes for electron gun parts.

In FIG. 1 is shown a cross section of a color picture tube of the shadow mask type already known in the art. A panel 1 is coated on the back side with a phosphor film 2 that generates the three primary colors of red, green, and blue. In the neck is housed an electron gun 4 that emits electron beams 3. The electron beams 3 are deflected in scanning by a deflection yoke 5. The numeral 6 indicates a shadow mask and the numeral 7 indicates a magnetic shield.

In FIG. 2, (*a*) and (*b*) are perspective and cross sectional views, respectively, of an electrode 10 as an example of a punched part to be fitted in the electron gun 4. The electrode 10 acts to accelerate electrons emitted from a cathode in the electron gun. The electrode has small holes 10*a,* 10*b,* and 10*c* made by coining and punching so as to allow red, green, and blue color-generating beams, respectively, to pass through them.

In general, the electron gun parts for use in picture tubes and the like are completed by blanking and press punching (called hereinafter merely punching), with or without coining, a sheet of nonmagnetic stainless steel about 0.05 to 0.5 mm thick. Recently in the case of the electrode 10 that is located in the vicinity of the cathode fitted in the electron gun 4, more weight has been put on low thermal expansion properties than on the nonmagnetism. With the advent of higher refinement, higher performance picture tubes for computer displays and the like in recent years, it has been noted that subtle dimensional changes with thermal expansion of electrodes influence the picture quality (color purity) on the panel 1 (see FIG. 1).

To cope with the situation, Fe—Ni alloys having low-expansion properties, notably Fe—42% Ni alloy (42 alloy), have come into use as electrode materials. The 42 alloy of the prior art, however, presents a burr formation problem. That is, as electrode blanks of the 42 alloy are punched with a pattern of small holes 10*a,* 10*b,* and 10*c* each, burrs B are formed on the edges 10*e* of the holes where punches have forced slugs down and cut them off from the blank (see FIG. 2). The burrs that result from the punching have adverse effects upon the control of the electron beams, sometimes prove fatal to the electron guns. The tendency toward picture tubes of even greater refinement is making the requirement for the reduction of burring from electron gun parts more and more exacting.

Improvements in the punching properties of Fe—Ni alloys have hitherto been proposed, for example, in Japanese Patent Application Kokai Nos. 6-184703, 6-122945, 7-3400, and 7-34199.

Of those proposals, Kokai No. 6-184703 specifies the S content in the range of 0.002 to 0.05% and disperses S or S compounds along grain boundaries or within grains in the alloy stock. However, the mere addition of S, a free-cutting element, in a specified percentage cannot be deemed adequate for the control of burrs in the modern punching working to most precise specifications.

The remaining Kokai Nos. 6-122945, 7-3400, and 7-34199 propose adding such strengthening elements as Ti, Nb, V, Ta, W, or/and Zr to the alloy for imparting increased hardness and proper extent of embrittlement to the alloy to suppress burring. These proposals, however, posed problems of shortened punching die life with increased hardness.

This invention has for its object to settle the afore-described problems of the prior arts and provide a process for producing Fe—Ni alloys for electron gun parts which is improved in punching properties without attendant shortening of die life.

BRIEF SUMMARY OF THE INVENTION

The inventors have intensively studied on the influence of inclusions upon the punching properties and the influence of process conditions upon distribution of the inclusions. As a result, the inventors have successfully solved the above problems by improving the punching properties of the Fe—Ni alloys used for electron gun parts by restricting the contents of Mn and S within specific ranges, and by hot working at suitable temperatures which depend on the contents of Mn and S.

More specifically, MnS precipitated in the material in a proper amount improves the punching properties by accelerating initiation and propagation of a crack in a punching operation. In accordance with inventors study, it was found that the mere restriction of the S content cannot be sufficient for controlling quantity and distribution of MnS to improve the punching properties, that are more affected by heating temperatures in hot working. Moreover, the inventors have discovered that the proper range of the heating temperatures in hot working varies according to the contents of Mn and S. Therefore, the present invention can provide alloys satisfying the severe requirement with respect to the burrs formed on the electron gun parts for the first time by controlling the heating temperature and the contents of Mn and S in proper ranges. Moreover, according to the present invention, the die life can remain long because MnS which improves punching properties in the present invention does not significantly increase hardness of alloys.

The present invention is completed based on the above mentioned knowledge. That is to say, the invention provides a process for producing Fe—Ni alloys used for electron gun parts consisting of: all by weight, 30 to 55% of Ni; 0.05 to 2.00% of Mn; 0.001% to 0.050 of S; and the balance of Fe and inevitable impurities. The process substantially consists of melting, casting, hot working, cold rolling, and annealing. The Fe—Ni alloy satisfies $0.0005 \leqq ((\%Mn)*(\%S)) \leqq 0.100$. The hot working is carried out at a temperature T defined by the following equation.

$$1050 \leqq T\ ^{\circ}\mathrm{C.} \leqq \frac{9500}{3.1 - \log\left[((\%\ Mn)*(\%\ S))\right]} - 350 \qquad (1)$$

In the following, the reasons of the above numerical limitations will be explained together with the effects of the present invention. In the following explanation, "%" means "weight %".

(Ni): Ni is an important element that determines thermal expansion characteristic of an Fe—Ni alloy. If its content is less than 30% or more than 55%, the alloy is undesirable with a too high thermal expansion coefficient. Hence the Ni content is restricted within the range of 30 to 55%.

(Mn): Mn forms MnS together with S, and MnS improves the punching properties as mentioned above. If its content is less than 0.05%, sufficient punching properties cannot be obtained. On the other hand, if the Mn content exceeds 2.00%, hardness of the alloy increases, thereby accelerating wear of die. Therefore, the Mn content is restricted within the range of 0.05 to 2.00%. More preferable range of the Mn content is 0.05 to 0.80%.

(S): S forms MnS together with Mn, and MnS improves the punching properties. If its content is less than 0.001%, sufficient punching properties cannot be obtained. On the other hand, if the S content exceeds 0.050%, hot working properties and corrosion resistance are deteriorated. Therefore, the S content is restricted within the range of 0.001 to 0.050%. More preferable range of the S content is 0.003 to 0.020%.

Further elements included in the alloy except for the above elements are Fe and inevitable impurities. The inevitable impurities may be ordinary impurities, C, Si, Al, P and Cr. Such impurities are harmful for thermal expansion characteristic. Therefore, the entire amount of the impurities should be within the range of 0.001 to 0.5%.

(Concentration product of Mn and S ((%Mn)*(%S)): Concentration product ((%Mn)*(%S)) is a parameter noticed by the inventor at the first time with respect to improvement of the punching properties of an Fe—Ni alloy used for electron gun parts. Amount of MnS can be more certainly controlled by restricting the range of the concentration product ((%Mn)*(%S)) than the case that contents of Mn and S are individually restricted. According to the inventors study, if the concentration product ((%Mn)*(%S) is less than 0.0005, MnS which is effective for improvement of punching properties does not sufficiently precipitate. On the other hand, if the concentration product ((%Mn)*(%S)) exceeds 0.0100, the amount of MnS becomes too high, thereby deteriorating corrosion resistance. Therefore, the concentration product ((%Mn)*(%S)) is restricted within the range satisfying the following equation.

$$0.0005 \leqq ((\%Mn)*(\%S)) \leqq 0.0100 \quad (2)$$

(Heating temperature in hot working): If the heating temperature in hot working is too low, MnS becomes too small to improve punching properties. According to the inventors' study, the heating temperature in hot working must be at least 1050° C. If the heating temperature in hot working is too high, MnS which is effective for improvement of punching properties dissolves into Mn and S, and the dissolved Mn and S (solid solution) in the matrix are no longer effective.

Therefore, the heating temperature in hot working must be controlled in a proper range, which varies according to contents of Mn and S. This critical temperature depends on ((%Mn)*(%S), and is described as $$T\,(^\circ\,\mathrm{C.}) = \frac{9500}{3.1 - \log((\%\ Mn)*(S))} - 350 \quad (3)$$

The above explained proper ranges of ((%Mn)*(%S)) and the heating temperature T(° C.) are indicated in FIG. 3. In this case, "hot working" includes bloming, hot forging or hot rolling.

In order to produce an Fe—Ni alloy for electron gun parts according to the invention, a smelted Fe—Ni alloy ingot or a continuously cast slab having the above chemical composition is hot worked at the above heating temperature. The hot worked material is repeatedly cold rolled and annealed to obtain a cold rolled sheet having predetermined thickness. Then, the final annealing is carried out to the sheet for finishing, and a material having a thickness of about 0.05 to 0.5 mm for punching is obtained.

DETAILED DESCRIPTION OF THE INVENTION

The present invention will be explained referring to the following description of examples of the invention and comparative examples. Six kinds of Fe—Ni alloys containing Fe—42 weight % Ni as a main component were smelted by vacuum induction melting, and were cast to 300 kg ingots. Raw materials for the alloy were properly chosen from the group of electrolytic Fe, electrolytic Ni, electrolytic Mn. The S content was adjusted by mixing iron sulfide (Fe—S) to the material. The chemical compositions of the alloys are shown in Table 1.

A 40 mm thick sheet was cut out from each ingot, treated at each temperature shown in Table 1 for 1 hour and hot rolled into a 4 mm thick plate. The plate was annealed and pickled, then was cold rolled into a 1.5 mm thick plate. Then, the plate was annealed and cold rolled into a 0.5 mm thick sheet, followed by final annealing in vacuum at 750° C. for 1 hour to obtain test pieces.

Figure 1:
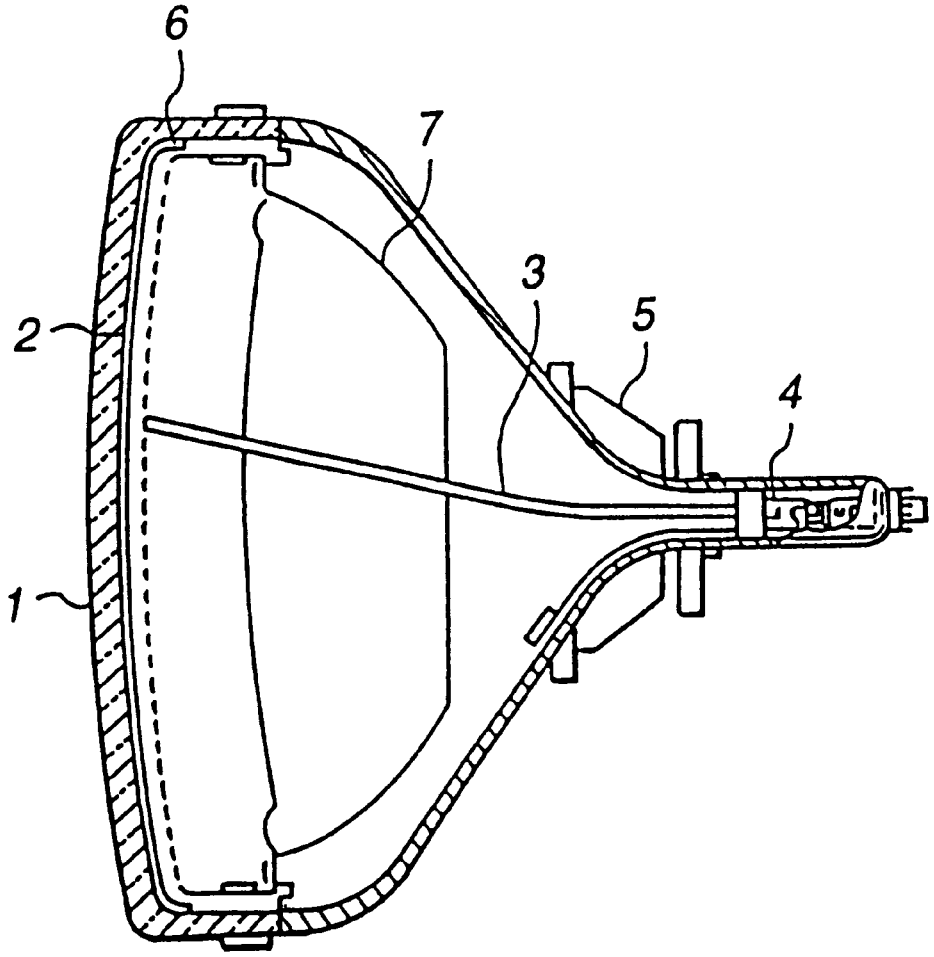
FIG. 1 is a cross sectional view of a shadow mask type picture tube.
Figure 2:
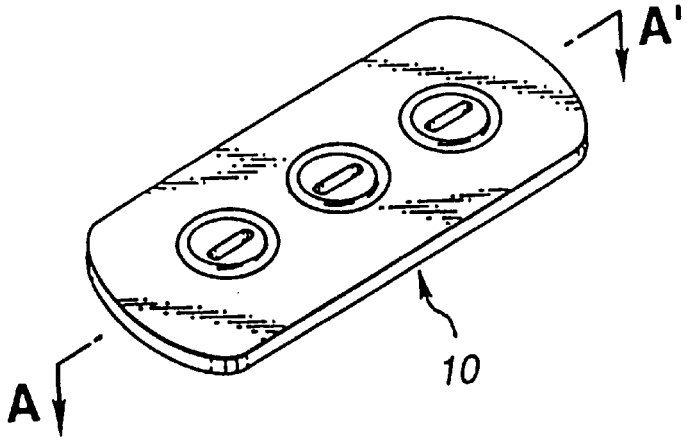
FIG. 2 (*a*) is a perspective view of an electrode for an electron gun as an example of punched part according to this invention and FIG. 2(*b*) is cross sectional view taken along the line A—A' in FIG. 2(*a*).
Figure 2:
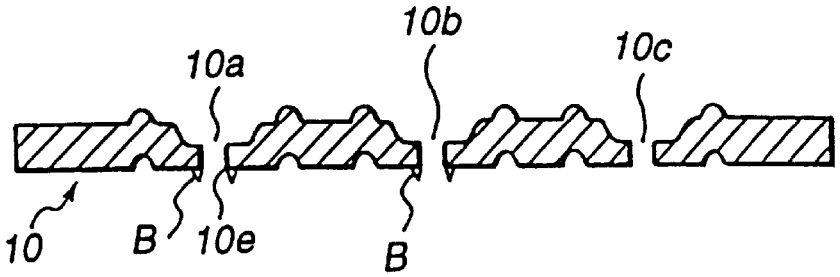
Figure 3:
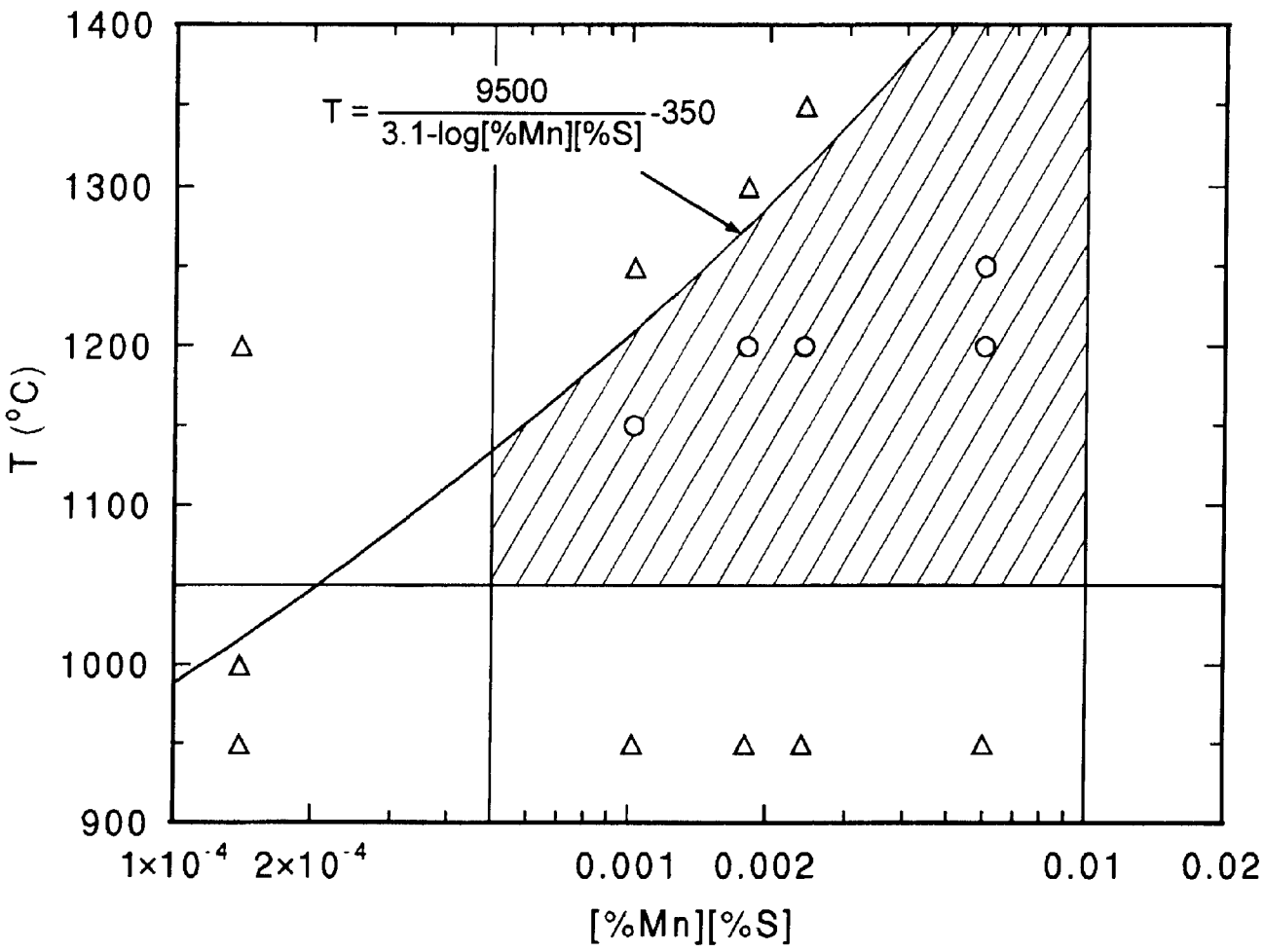
FIG. 3 is a diagram showing the proper ranges of the concentration product ((%Mn)*(%S)) and the heating temperature in hot working.

Coining was carried out prior to punching test to each test piece, so that the thickness of the test pieces was reduced to 0.28 mm. Then, ten holes with diameter of 0.4 mm were punched in each test piece. Thickness fraction of fracture surface, which is defined as the ratio of thickness of fracture surface to that of the total thickness was measured for evaluation of the punching properties. The results of the measurement are shown in Table 1. The thickness fraction of the fracture surface that is indicated in Table 1 is an average of those of ten holes. In Table 1, the test piece with a hot rolling temperature within the example of which hot rolling temperature was in the range of the invention is referred to "Example of the invention". The test piece with a hot rolling temperature beyond the example of which hot rolling temperature was not in the range of the invention is referred to "Comparative example". In FIG. 3, the concentration product ((%Mn)*(%S)) (horizontal axis) and the heating temperature in hot rolling (vertical axis) of the examples, except for N.6, are plotted. "Thickness fraction of fracture surface (%)" is defined as (thickness of fracture surface/thickness of sheet)×100, and the thickness of sheet is the total of the shearing surface and the fracture surface. According to the inventors' study of the punching properties, it was already known that the burr height decreases as thickness surface of fracture surface increases. In the punching conditions of the examples, the punching properties are excellent when the thickness fraction of fracture surface is 30% or more.

As shown in Table 1, in all the examples of the invention, the thickness fraction of fracture surface exceeds 30%, indicating that punching properties are superior compared to the comparative examples. Since the S content of Example No. 6 exceeds the range of the invention, alloy No.6 cracked in hot rolling. Therefore, punching properties of No. 6 could not be evaluated. As mentioned above, equation (3) is based on the plotted marks in FIG. 3, that clearly distinguishes the examples of the invention with excellent punching properties and the comparative examples without such advantage.

Thus, according to the invention, Fe—Ni alloys for electron gun parts having remarkably improved punching properties can be provided. These alloys can solve the burr problem which is fatal for electron gun parts, and can satisfy the recent demand for higher picture quality.

TABLE 1

| Alloy No. | Chemical composition (weight %) Ni | Mn | S | Fe | ((% Mn)*(% S)) | $\frac{9500}{3.1-\log((\%\ Mn)*(\%\ S))}-350$ | Heat temperature (° C.) | Thickness fraction of fracture surface (%) | Remark |
|---|---|---|---|---|---|---|---|---|---|
| 1 | 41.1 | 0.51 | 0.002 | Bal. | 0.00102 | 1210 | 950 | 18.7 | Comparative Example |
| | | | | | | | 1150 | 31.3 | Example of the Invention |
| | | | | | | | 1250 | 22.2 | Comparative Example |
| 2 | 41.0 | 0.48 | 0.005 | Bal. | 0.00240 | 1311 | 950 | 20.9 | Comparative Example |
| | | | | | | | 1200 | 33.4 | Example of the Invention |
| | | | | | | | 1350 | 24.5 | Comparative Example |
| 3 | 40.8 | 0.50 | 0.012 | Bal. | 0.00600 | 1435 | 950 | 22.1 | Comparative Example |
| | | | | | | | 1200 | 34.2 | Example of the Invention |
| | | | | | | | 1250 | 33.1 | Example of the Invention |
| 4 | 41.3 | 1.80 | 0.001 | Bal. | 0.00180 | 1275 | 950 | 19.8 | Comparative Example |
| | | | | | | | 1200 | 32.5 | Example of the Invention |
| | | | | | | | 1300 | 23.6 | Comparative Example |
| 5 | 41.0 | 0.07 | 0.002 | Bal. | 0.00014 | 1016 | 950 | 19.4 | Comparative Example |
| | | | | | | | 1000 | 20.1 | Comparative Example |
| | | | | | | | 1200 | 18.5 | Comparative Example |
| 6 | 40.8 | 0.52 | 0.080 | Bal. | 0.04160 | 1770 | 950 | — | Comparative Example |
| | | | | | | | 1100 | — | Comparative Example |
| | | | | | | | 1200 | — | Comparative Example |

What is claimed is:

1. A process for producing Fe—Ni alloys used for electron gun parts consisting of: all by weight, 30 to 55% Ni; 0.05 to 2.00% Mn; 0.001 to 0.050% S; and the balance Fe and unavoidable impurities, said process comprising of melting, casting, hot working, cold rolling and annealing, said Fe—Ni alloy satisfying $0.0005 \leqq ((\%Mn)*(\%S)) \leqq 0.0100$ wherein (%Mn) is the content of Mn and (%S) is the content of S, said hot working is carried out at a temperature, T, defined by the following equation:

$$1050 \leqq T^{\circ}\text{C.} \leqq \frac{9500}{3.1-\log((\%\ Mn)*(\%\ S))}-350.$$

2. A process for producing Fe—Ni alloys used for electron gun parts according to claim 1, wherein said Mn content is 0.05 to 0.8 weight %.

3. A process for producing Fe—Ni alloys used for electron gun parts according to claim 2, wherein said S content is 0.003 to 0.020 weight %.

* * * * *